United States Patent [19]

Menick

[11] 4,398,403

[45] Aug. 16, 1983

[54] COMPACT, PORTABLE LOCKING MECHANISM

[76] Inventor: Douglas B. Menick, 17830 Sherman Way, #266, Reseda, Calif. 91335

[21] Appl. No.: 316,887

[22] Filed: Oct. 30, 1981

[51] Int. Cl.[3] ..... E05B 73/00

[52] U.S. Cl. ..... 70/58; 70/18

[58] Field of Search ..... 70/58, 57, 18; 211/4, 211/8, 60 SK; 224/917; 280/814, 820

[56] References Cited

U.S. PATENT DOCUMENTS

| | | | |
|---|---|---|---|
| Re. 30,523 | 2/1981 | Rich | 70/58 |
| 3,999,410 | 12/1976 | Hall | 70/58 |
| 4,059,209 | 11/1977 | Grisel | 280/814 |
| 4,171,079 | 10/1979 | Dietlein | 224/45 S |
| 4,245,745 | 1/1981 | Verelle | 211/8 |

*Primary Examiner*—Robert L. Wolfe

*Attorney, Agent, or Firm*—Jack C. Munro

[57] ABSTRACT

The compact, portable locking mechanism designed primarily to be utilized in conjunction with skiis and ski poles, which takes the form of a housing having an internal chamber. The housing is normally closed by a side wall assembly. The side wall assembly is capable of being pivotally moved to an open position providing access into the interior chamber. When in the open position, the side wall assembly is to be lockable by a separate locking device defining a first enlarged locking area between the housing and the side wall assembly. A wire member is also attached to the housing and is to be utilized to define a second enclosing locking area. The separate locking device is normally to be stowed within the internal chamber when not in use, with the side wall assembly being in alignment with the periphery of the housing defining an totally enclosed structure. The skiis are to be locked confined with the first enclosing locking area, with the ski poles to be located within the second enclosing locking area.

10 Claims, 11 Drawing Figures

COMPACT, PORTABLE LOCKING MECHANISM

BACKGROUND OF THE INVENTION

The field of this invention relates to anti-theft devices, and more particularly to an anti-theft device which is designed primarily for use in conjunction with ski equipment.

When skiis are not in use, they are commonly strapped, or otherwise fastened together with the relatively flat bottom surfaces of the skiis in contact with each other. When fastened together in this manner, the skiis are easy to carry about and are readily stored in racks or by thrusting the rearward end of the skiis vertically into a bank of snow outside a house or lodge. The owner of skiis, temporarily stored in this manner, frequently leaves the skiis unattended while engaging in other activities. Skiis strapped together and stored unattended can easily be carried away by an unauthorized person (a thief). A thief carrying off stolen skiis strapped together in the usual manner is almost impossible to distinguish from the scores of other skiers in the area who are legimately carrying their own skiis strapped together in an identical fashion. As a result, the theft of skiis at ski resorts is a growing problem that is difficult to control because of the unobtrusive way in which a thief can purloin the skiis.

A number of devices have heretofore been proposed for preventing the theft of skiis at ski resorts and similar places. However, most of the prior art devices of this type have been large in size and difficult to carry. In other words, locking devices should be readily carried on the person so that, when the individual stops skiing for a short period of time, the locking device can be then readily attached to the skiis to thereby prevent the unauthorized removal of the skiis. A common way that such locking devices are utilized is that they are locked onto ski racks or other fixed objects, such as trees, light poles, etc.

Another disadvantage of prior art locking devices is that they have been quite expensive. Not only are they bulky in size, but they are complex in construction which inherently increases their expense.

It is desirable to construct a compact locking device which can be readily carried by a skier during the time that the skier is skiing. At the time the skier stops skiing for any period of time, the locking device can be readily extracted and quickly connected to the skiis to lock the skiis at a particular location to prevent unauthorized removal of the skiis.

SUMMARY OF THE INVENTION

The structure of this invention relates to a small size, portable locking mechanism which is in the basic shape of a square box. This box can be readily held within the hand of an adult human being. The interior of the box is substantially hollow, forming an interior chamber. The edge of the box is normally closed by means of a side wall assembly. The side wall assembly is normally latched to the housing and upon being delatched, the entire side wall assembly can be pivoted with respect to the housing to form a first enclosing locking area. The free end of the side wall assembly, when in the position defining this first enclosing locking area, is to be lockable with the housing be means of a separate locking device. The separate locking device is normally contained within the internal chamber when not in use. A wire member is also attached to the housing which is to be connectable with a separate locking device to form a second enclosing locking area. The first enclosing locking area is to be adjustable in size by varying the location of the movable portion of the side wall assembly with respect to the housing. A pair of skiis is to be passed through the first enclosing locking area, with a pair of ski poles to extend through the second enclosing locking area.

The primary objective of this invention is to construct a locking mechanism which can quickly and easily lock together a pair of skiis and a pair of ski poles and then secure such to a fixed object, such as a tree, a pole, or the like.

A further objective of this invention is to construct a locking mechanism which is light in weight and which occupies a substantially small space when not in use, so that it can be readily carried by an individual.

A further objective of this invention is to construct a ski lock which can be manufactured relatively inexpensively.

DETAILED DESCRIPTION OF THE SHOWN EMBODIMENT

Figure 1:
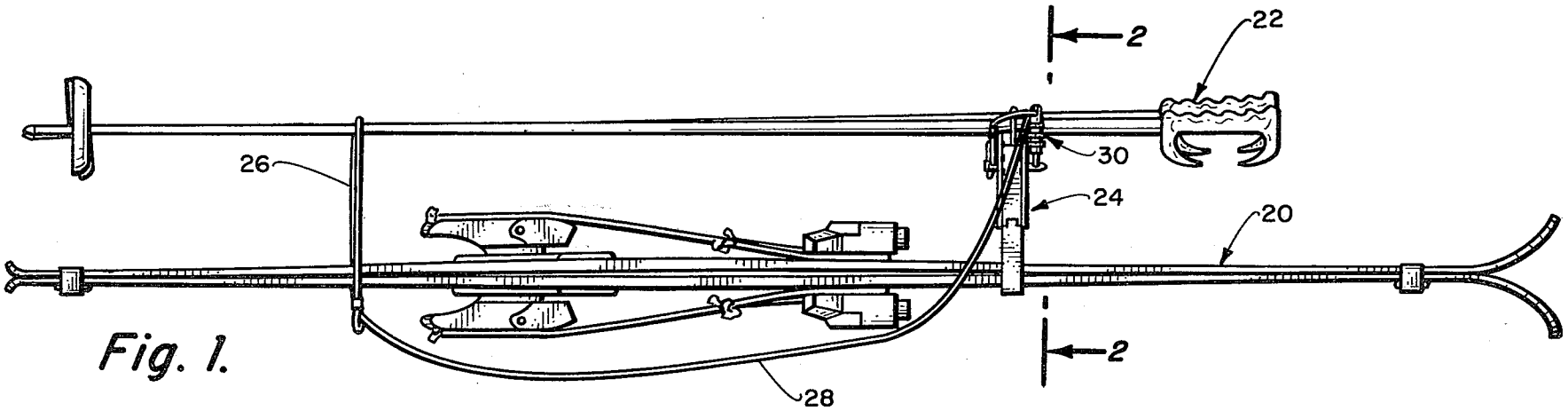
FIG. 1 is a side, elevational view showing a pair of skiis and ski poles which are connected together with the locking mechanism of this invention.
Figure 11:
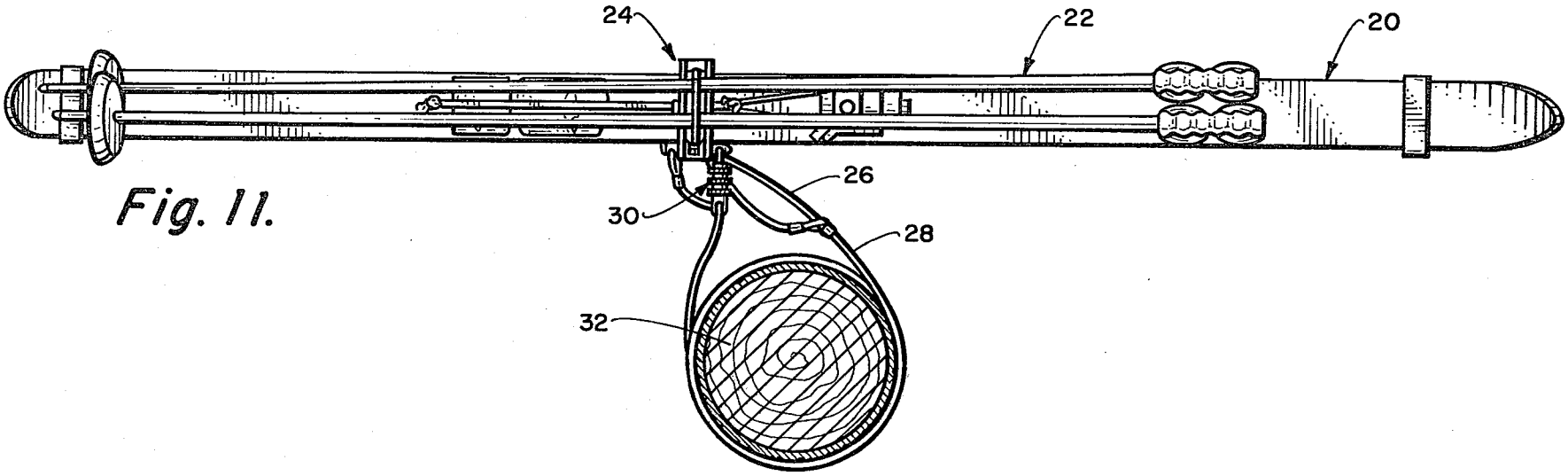
FIG. 11 is a top, plan view of the locking mechanism of this invention showing it connected with a pair of skiis and a pair of ski poles and being wrapped around a fixed structure, such as the trunk of a tree.

Referring particularly to the drawings, there is shown in FIG. 1 a conventional pair of skiis 20 which are mounted in a back-to-back relationship and a conventional pair of ski poles 22 which are mounted in a side-by-side relationship. The locking mechanism 24 of this invention shown attached to the skiis 20 and also to the poles 22. It is to be noted that the ski poles 22 function as a carrying handle when transporting the skiis 20 and the ski poles 22. The outer end of the ski poles 22 are held in position by means of a looped portion 26 of a cable 28. This location of the loop 26 is only during carrying of the skiis 20 and the ski poles 22. As shown in FIG. 11, the cable 28 connects with a combination type of locking device 30. The locking device 30 is deemed to be conventional and forms no specific part of this invention. It is considered to be within the scope of this invention that other types of locking devices, such as padlocks could be utilized.

When it is desired to secure the skiis 20 and the ski poles 22 to a fixed object, such as the truck of a tree 32, the cable 28 is extended around the trunk of the trees 32. In this securing position, it is to be noted that the locking mechanism 24 is positioned in between the ski bindings so the skiis cannot be withdrawn from the locking mechanism 24 without unlocking the locking device 30. In the carrying position shown in FIG. 1, the locking mechanism 24, for purposes of balance, will be located near the fore end of the skiis, since during carrying of the skiis, thievery is not a problem.

Referring particularly to FIGS. 2–10 of the drawings, the locking mechanism 24 of this invention is composed generally of a housing 34 and a side wall assembly 36. Basically, the housing 34 is composed of a pair of rectangularly shaped sheet material plates 38 and 40. The plates 38 and 40 are both the same size and are located in a parallel facing relationship forming an internal chamber 42 therebetween. Fixedly securing together the plates 38 and 40 are a plurality of spaced-apart pins 44, 46, and 48.

Formed within the inside surface of the plate 38 is a latching groove 50. A similarly shaped groove 52 is formed on the inside surface of the plate 50. The groove 52 is located in a facing alignment position with the groove 50.

The side wall assembly 36 includes a movable portion or section 54. The length of the movable section 54 is so that it is capable of closing off one open side of the internal chamber 42. The outermost end of the movable section 54 includes a resting ledge 56. The purpose of the ledge 56 will be explained further on in the specification.

Figure 9:
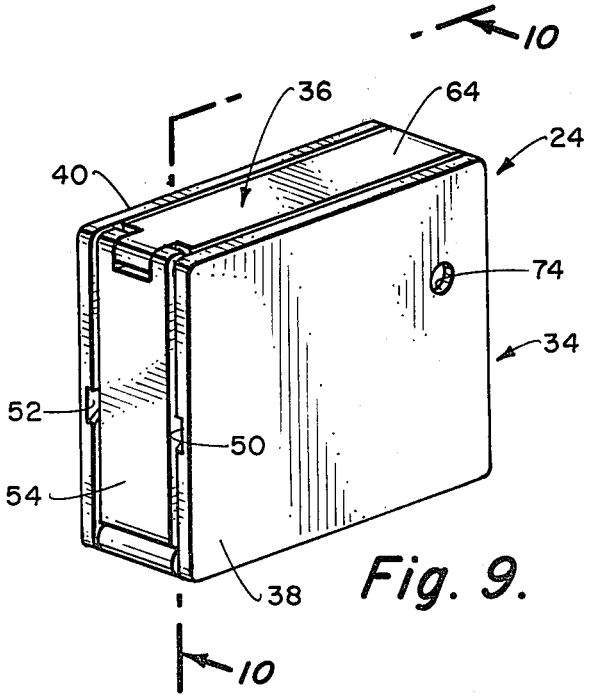
FIG. 9 is an isometric view of the locking mechanism of this invention which is shown in the closed non-usable state.

Extending from one lateral side of the movable section 54 is a pin 58. This pin 58 is to connect with the groove 50. Similarly, an aligned pin 60 is to be connectable with the groove 52. The pins 58 and 60 can be slipped into their respective slots 50 and 52 in order to latch the movable section 54 to the housing 34 when in the closed position, as shown in FIG. 9.

Figure 2:
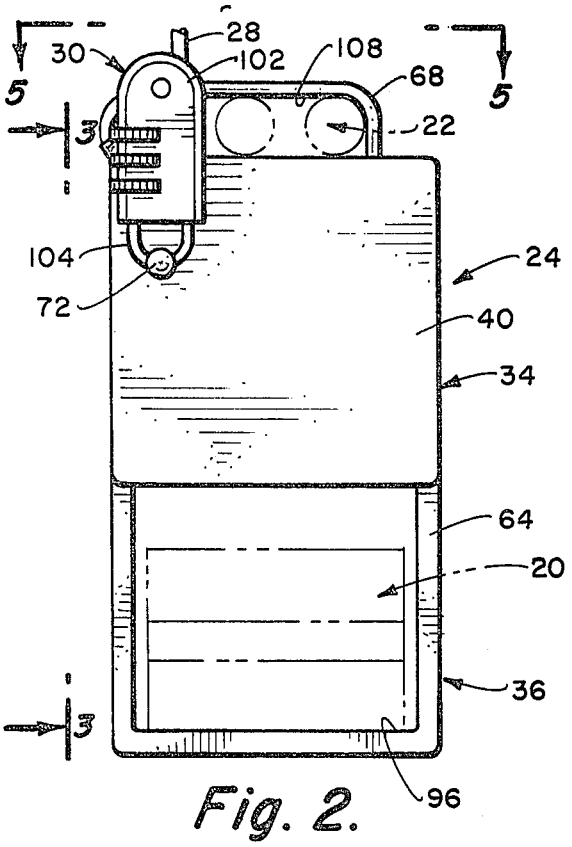
FIG. 2 is a front elevational view taken along line 2—2 of FIG. 1, of the locking mechanism of this invention showing the locking mechanism in the operable position.
Figure 3:
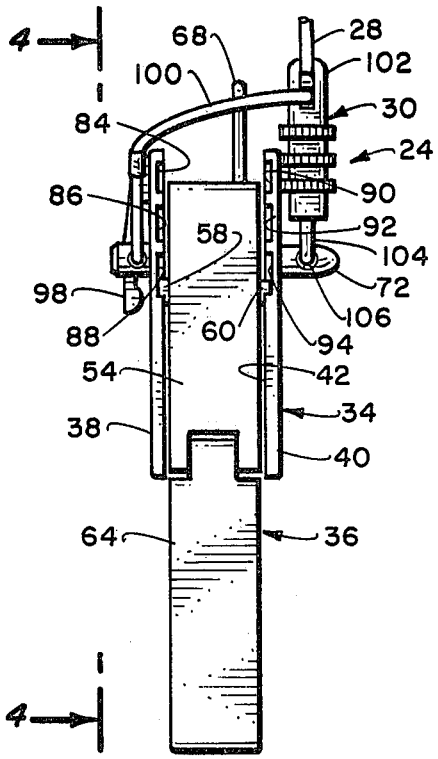
FIG. 3 is a side elevational view taken along line 3—3 of FIG. 2.
Figure 4:
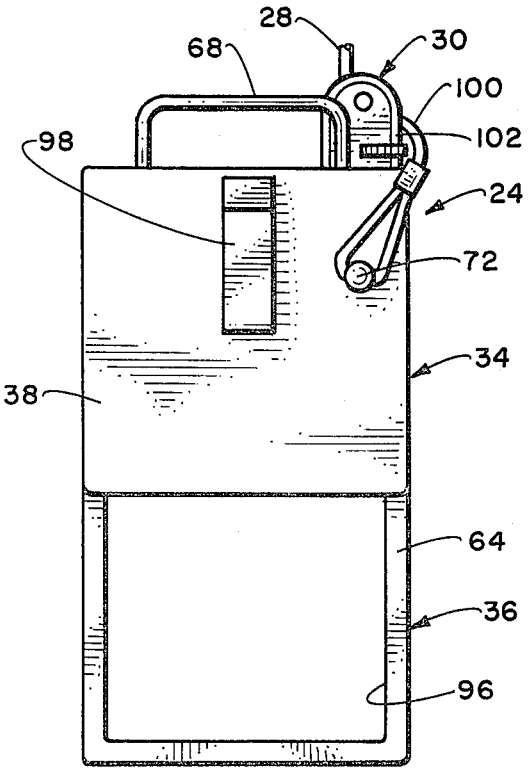
FIG. 4 is a back elevational view of the locking mechanism taken along line 4—4 of FIG. 3.
Figure 5:
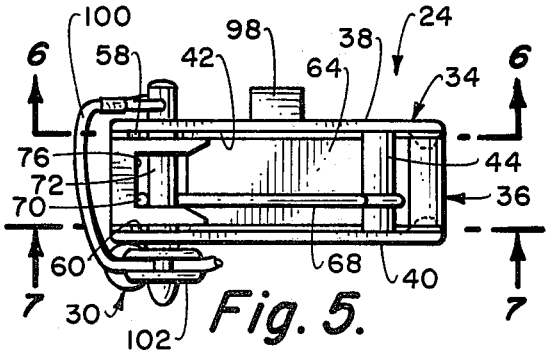
FIG. 5 is a top plan view of the locking mechanism of this invention taken along line 5—5 of FIG. 2.
Figure 6:
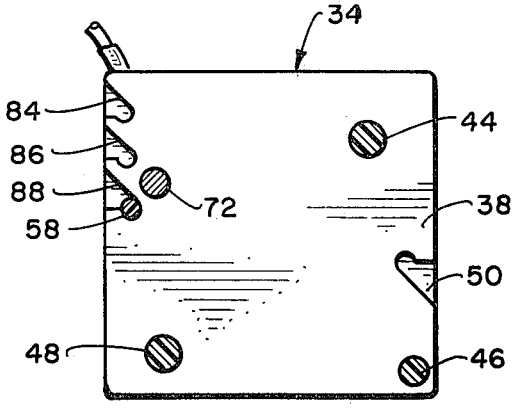
FIG. 6 is a partly cross-sectional view taken along line 6—6 of FIG. 5.

The movable section 54 is pivotally secured by a pivot pin 62 to the fixed section, or portion 64 of the side arm assembly 36. The fixed section 64 is substantially U-shaped. The free end of the fixed section 64 is pivotally attached to the housing 34 by means of the pin 46. The sides of the fixed section 64 are such that the exterior of the fixed section 64 will lie substantially flush with the peripheral edges of the housing 34. This is clearly shown in FIGS. 9 and 10. It is also to be understood that by exerting a slight inward force on the portion of the fixed section 64 directly adjacent the pivot pin 62, that the movable section 54 will be slightly moved so as to disengage the pins 58 and 60 from their respective grooves 50 and 52. At this particular time, the movable section 54 is then pivoted about the pivot pins 62 to an extended position. The fixed section 64 is then pivoted ninety degrees about the pin 46. This causes the side wall assembly 36 to be moved from the position shown in FIG. 9 to a position which is shown in FIG. 2.

Pivotally mounted on the pin 44 is a U-shaped wire member 68. The free end of the U-shaped wire member 68 includes a hook 70. The hook 70 is to be capable of engaging with removable pin 72. The removable pin 72 is to extend through opening 74 formed within the plate 38 and also through a similarly aligned opening (not shown) formed within the plate 40. The hook 70, when engaged with the pin 72, is located within channel shaped opening 76 formed within the movable block 54. It is to be understood that the movable pin 72 is also to be conducted through one of the holes 78, 80 and 82 formed within the movable section 54.

Figure 7:
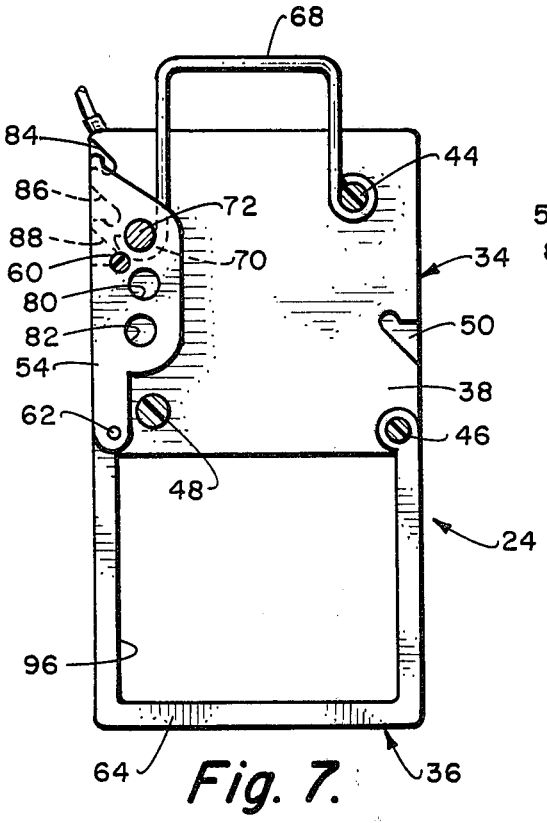
FIG. 7 is a view, partly in cross-section, taken along line 7—7 of FIG. 5.
Figure 8:
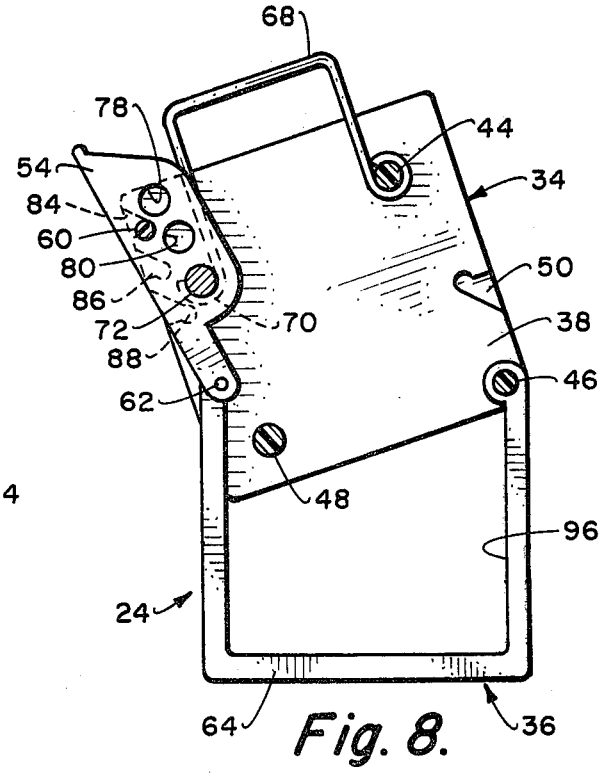
FIG. 8 is a view similar to FIG. 7 but showing the locking mechanism is a slightly different position.

With the side wall assembly 36 located in the open position as shown in FIGS. 7 and 8, the pin 58 is to engage with one of three different spaced apart grooves 84, 86 and 88 formed on the inner surface of the plate 38. A similar set of grooves 90, 92 and 94 are formed within the inner surface of the plate 40. With pin 58 engaging with groove 84, pin 60 will engage with groove 90. Similarly, with pin 58 engaging with groove 86, pin 60 will engage with groove 92. When pin 58 engages groove 88, pin 60 will engage groove 94. It can be seen that this provides an area of adjustment for the enlarged enclosing area 96 defined by the fixed portion 64 and the lower edge of the housing 34. By locating of the pins 58 and 60 within the different slots 84–94, the sides of the enlarged enclosing area can be varied such as clearly shown in comparing FIGS. 7 and 8 of the drawings. The reason for this is that certain skiis are of a lesser thickness. Therefore, it may be desirable to locate the locking mechanism 24 in the canted position shown in FIG. 8 so as to have the locking mechanism be positioned more snugly about the skiis 20.

It is to be noted that to facilitate the securing of the locking mechanism 24 when not in use, that a clip 98 is attached to the exterior surface of the plate 38. The purpose of the clip 98 is for the locating of a piece of fabric between the clip 98 and the exterior surface of the plate 38 to thereby securely connect the locking mechanism 34 to the fabric so as to help prevent losing of the locking mechanism 34 when not in use.

With the locking mechanism 34 in the position shown in the closed position shown in FIG. 9, the locking device 30, as well as its associated cable 28 is confined within the internal chamber 42. Upon moving of the side wall assembly 36 to the position shown in FIG. 7, the locking device 30 and the cable 28 is removed. The side wall assembly 36 is then moved about the skiis 20 at the desired longitudinal location along the skiis 20. The skiis 20 will then be located within the enclosed area 96. The movable section 54 is moved so the selected hole 78, 80 or 82 aligns with the hole 74. The operator then inserts the pin 72 through the hole 74 so as to protrude exteriorly of the plate 40.

The portion of the pin 72 which protrudes from the plate 38 has attached thereto a section of cable 100. This cable 100 is fixedly secured to the housing 102 of the locking device 30. The shackle 104 of the locking device 30 extends through a hole 106 formed within the outer free end of the movable pin 72. With the locking device 30 so installed, as shown in FIG. 2, the pin 72 is then locked in place, with the movable section 54 being locked in place with respect to the housing 34. A cable 28 extends from the housing 102 the selected length until it connects with looped section 26. If the locking mechanism of this invention is being utilized to extend around a fixed object, such as a tree trunk 32 as shown in FIG. 11, the loop 26 will be conducted through the space interiorly of the shackle 104. Otherwise, if the locking mechanism 24 is being utilized to carry the skiis, the loop 26 will connect with the aft end of the skiis 20 and the forward end of the ski poles 22 as shown in FIG. 1.

Prior to inserting of the movable pin 72 in place, the wire member 68 will have been moved about the ski poles 22 so that the poles 22 are located in the enclosed area 108 defined by the member 68 and the upper end of the housing 34. The hook 70 is then located at the position shown in FIG. 7 and the pin 72 is inserted thereby locking in position the members 68.

Figure 10:
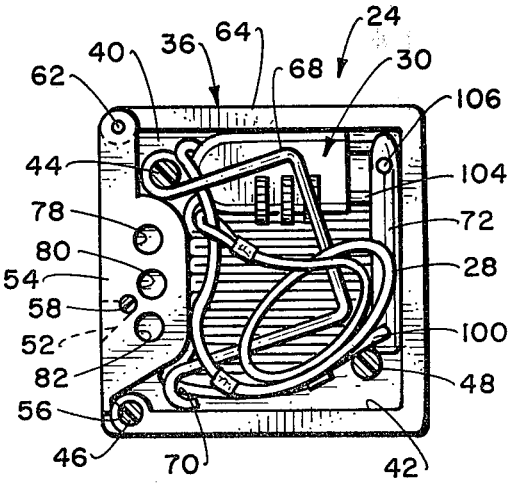
FIG. 10 is a cross-sectional view taken along line 10—10 of FIG. 9.

It is to be understood that upon unlocking of the locking device 30 and removing of the pin 72, both the ski poles 22 and the skis 20 will be permitted to disengage from the locking mechanism 24 of this invention. At that time, the locking mechanism 24 can be reassembled in the closed state as shown in FIGS. 9 and 10 of the drawings.

It is to be understood that the primary material of construction for the locking mechanism of this invention will be plastic. However, metal could be employed if desired.

What is claimed is:

1. A compact, portable locking mechanism comprising:

a housing having an internal chamber, said housing having a substantially open peripheral edge;

a side wall assembly capable of being located in a position substantially defining an enclosed area, said side wall assembly comprising a fixed portion and a movable portion, one end of said fixed portion being pivotally connected by first pivot means to said housing, said movable portion being pivotally connected by second pivot means to the free end of said fixed portion, said side wall assembly capable of being located in alignment with said peripheral edge defining a closed position totally enclosing said internal chamber, said side wall assembly capable of being pivoted about said first pivot means to an open position providing access through said peripheral edge into said internal chamber; and locking means for connecting said movable portion and said housing when said side wall assembly is in said open position forming a first enclosing locking area in between said housing and said fixed portion of said side wall assembly.

2. The mechanism as defined in claim 1 wherein:

said locking means comprising an elongated flexible member the ends of which are locked together by a locking device, said locking device including a lock, said lock to be openable and closeable, with said lock closed there is prevented unauthorized separation of the ends of said elongated flexible member, with said lock opened separation of said ends of said elongated flexible member is permitted.

3. The compact, portable locking mechanism as defined in claim 1 including:

latching means connected to said movable portion and said housing, said latching means to secure together said movable portion and said housing when said side wall assembly is in said closed position.

4. The compact, portable locking mechanism as defined in claim 1 including:

a second enclosing locking area being spaced from said first enclosing locking area, said second enclosing locking area being defined by a separate member connecting with said housing.

5. The compact, portable locking mechanism as defined in claim 4 wherein:

said separate member comprising a wire rod, said wire rod having a first end and a second end, said first end of said wire rod being permanently pivotally mounted on said housing, said second end of said wire rod being disconnectable from said housing to facilitate the insertion and removal of separate structure within said second enclosing locking area.

6. The compact, portable locking mechanism as defined in claim 5 wherein:

said wire rod being capable of being located entirely within said internal chamber.

7. The compact, portable locking mechanism as defined in claim 1 wherein:

said movable portion being adjustable to different positions relative to said housing to thereby vary the size of said first enclosing locking area.

8. The compact, portable locking mechanism as defined in claim 7 wherein:

said locking means comprising an elongated flexible member the ends of which are locked together by a locking device, said locking device including a lock, said lock to be openable and closable, with said lock closed there is prevented unauthorized separation of the ends of said elongated flexible member, with said lock opened separation of said ends of said elongated flexible member is permitted.

9. The compact, portable locking mechanism as defined in claim 8 wherein:

latching means connected to said movable portion and said housing, said latching means to secure together said movable portion and said housing when said side wall assembly is in said closed position.

10. The compact, portable locking mechanism as defined in claim 9 wherein:

a second enclosing locking area being spaced from said first enclosing locking area, said second enclosing locking area being defined by a separate member connecting with said housing.

* * * * *